US005687460A

United States Patent [19]

Foffano et al.

[11] Patent Number: 5,687,460

[45] Date of Patent: Nov. 18, 1997

[54] FASTENING DEVICE PARTICULARLY FOR SPORTS SHOES

[75] Inventors: Massimo Foffano, Treviso; Roberto Gorza, Feltre; Riccardo Perotto, Volpago del Montello, all of Italy

[73] Assignee: Nordica S.p.A., Trevignano, Italy

[21] Appl. No.: 530,262

[22] PCT Filed: Jan. 2, 1995

[86] PCT No.: PCT/EP95/00001

§ 371 Date: Aug. 31, 1995

§ 102(e) Date: Aug. 31, 1995

[87] PCT Pub. No.: WO95/18552

PCT Pub. Date: Jul. 13, 1995

[30] Foreign Application Priority Data

Jan. 5, 1994 [IT] Italy ..... TV940001 U
Feb. 22, 1994 [IT] Italy ..... TV940008 U

[51] Int. Cl.[6] ..... A43C 3/02

[52] U.S. Cl. ..... 24/713.4; 24/713.5

[58] Field of Search ..... 24/713.4, 713.5, 24/714.1, 714.8; 36/50.1, 50.5

[56] References Cited

U.S. PATENT DOCUMENTS

| | | | |
|---|---|---|---|
| 746,563 | 12/1903 | McMahon | 24/713.5 X |
| 786,406 | 4/1905 | Boynton | 24/714.8 |
| 1,094,357 | 4/1914 | Ayres | 24/714.1 X |

FOREIGN PATENT DOCUMENTS

| | | | |
|---|---|---|---|
| 1404799 | 5/1965 | France . | |
| 1883745 | 7/1963 | Germany . | |
| 24317 | 6/1902 | Switzerland | 24/713.5 |
| 208937 | 5/1940 | Switzerland . | |
| 403563 | 6/1966 | Switzerland . | |
| 11673 | 6/1899 | United Kingdom | 24/713.5 |

*Primary Examiner*—James R. Brittain
*Attorney, Agent, or Firm*—Guido Modiano; Albert Josif

[57] ABSTRACT

A fastening device particularly for sports shoes of the type which includes an upper or a shell that have two flaps or a tongue to be fastened by means of laces and/or of a cable. The device includes a plurality of pulley members which are associated with the upper or shell and guide the laces and/or cable. It is thus possible to quickly and easily fasten the flaps even for example at very low temperatures.

3 Claims, 5 Drawing Sheets

Fig. 8
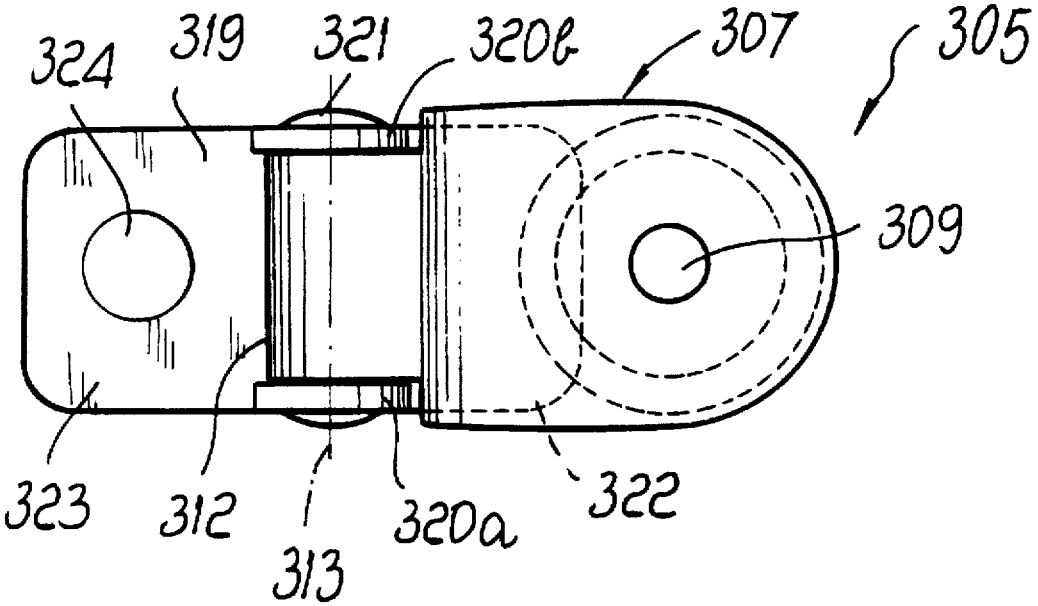
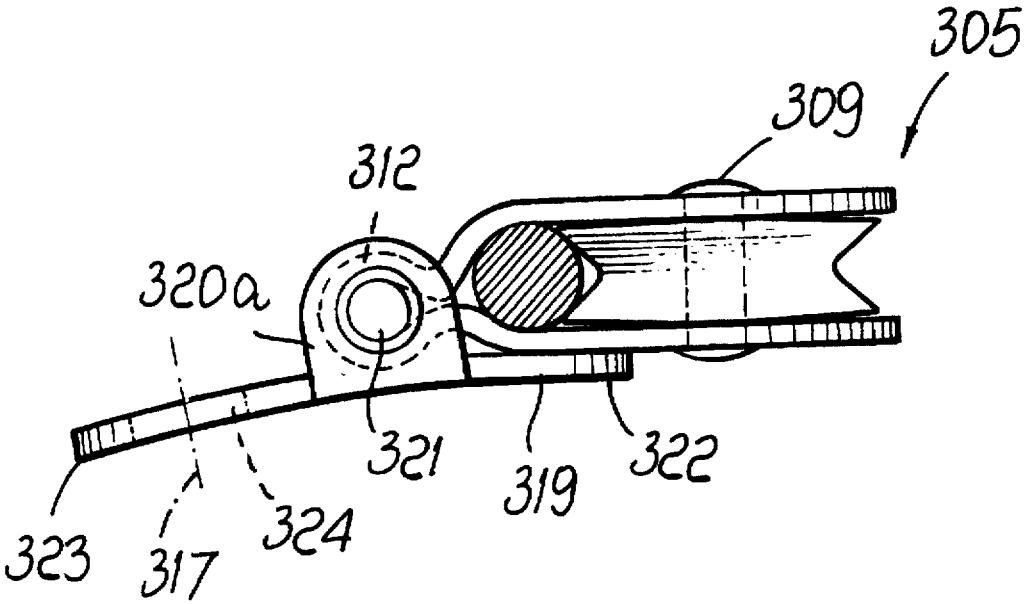
Fig. 9

FASTENING DEVICE PARTICULARLY FOR SPORTS SHOES

BACKGROUND OF THE INVENTION

The present invention relates to a fastening device particularly for sports shoes.

Conventional shoes, used for example for trekking or for climbing on rock or ice, comprise a shell or an upper which have two flaps or a tongue that must be fastened usually by means of laces or of a cable.

These tensioning elements are usually guided at adapted adjacent hooks or rings which are associated proximate to the edges of the flaps, so as to allow the cable or laces to pass several times transversely to the upper or shell.

The ends of the lace or cable are then fastened, for example by forming a knot or in any case by being taken up with an adapted conventional lever.

The use of these guiding elements, which are constituted, as mentioned, by hooks or rings, has some drawbacks: due to the considerable friction that is produced by the multiple passages of the lace transversely to the upper or shell, the application of tension to the ends of the lace does not allow optimum tensioning of all the parts of the lace.

This forces the user to pull, in each instance, the various portions of the lace which are arranged transversely to the upper before fastening the loose ends.

This method has drawbacks, as the operation must be performed at very low temperatures that make the lace stiff or in any case force the operator to use gloves which make the operation even more troublesome.

SUMMARY OF THE INVENTION

The aim of the present invention is to solve the described technical problems, eliminating the drawbacks of prior art by providing a device that allows to achieve optimum and easy fastening of laces or cables in shoes which comprise an upper or a shell which has two flaps or a tongue to be fastened.

Within the scope of this aim, an important object is to provide a device that allows to achieve this fastening even at very low temperatures or if the user is wearing gloves.

Another important object is to provide a device in which fastening can be achieved by the user merely by gripping the ends of the laces or of the cable or an adapted lever with which said ends are associated.

Another object is to provide a device which is structurally simple and has low manufacturing costs.

This aim, these objects, and others which will become apparent hereinafter are achieved by a fastening device particularly for sports shoes comprising an upper or a shell that have two flaps or a tongue to be fastened by means of laces or cables, characterized in that it comprises multiple pulley members which are associated with said upper or shell and guide said laces or cables.

BRIEF DESCRIPTION OF THE DRAWINGS

Further characteristics and advantages of the invention will become apparent from the detailed description of a particular embodiment, illustrated only by way of non-limitative example in the accompanying drawings, wherein:

FIG. 8 is a top view of a device according to still a further aspect of the invention;

FIG. 9 is a side view of the device of FIG. 8.

DESCRIPTION OF THE PREFERRED EMBODIMENTS

Figure 1:
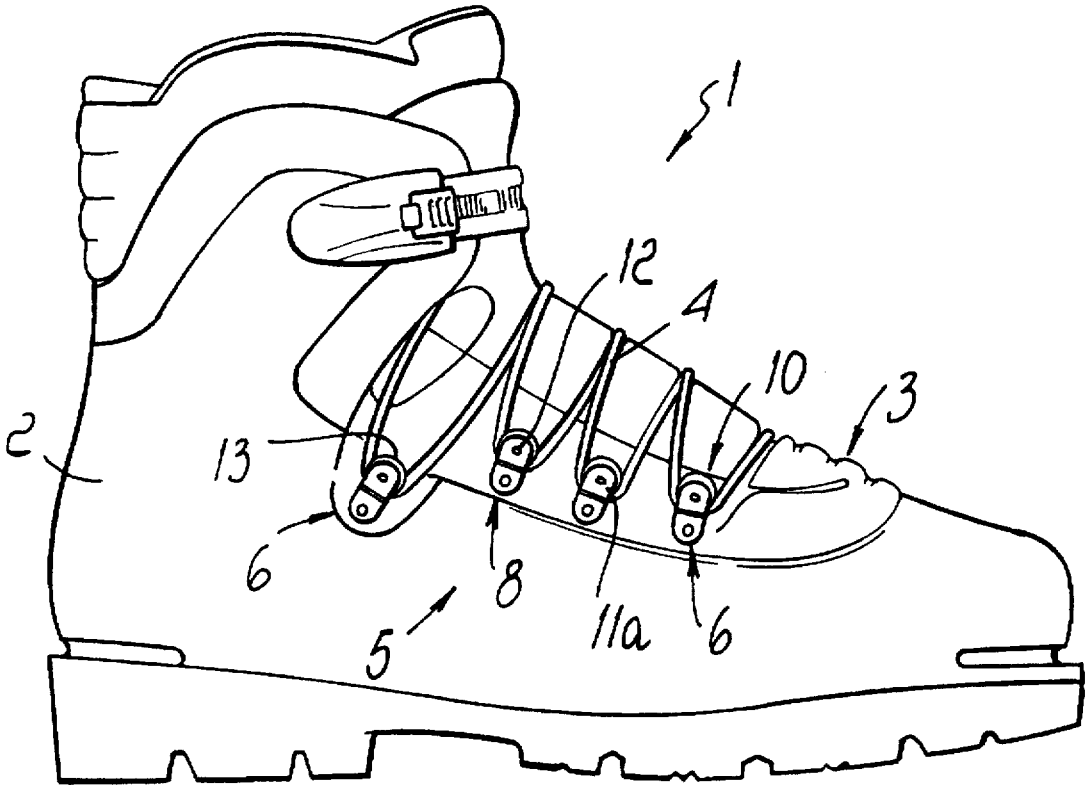
FIG. 1 is a side view of a sports shoe with the device applied thereto.
Figure 2:
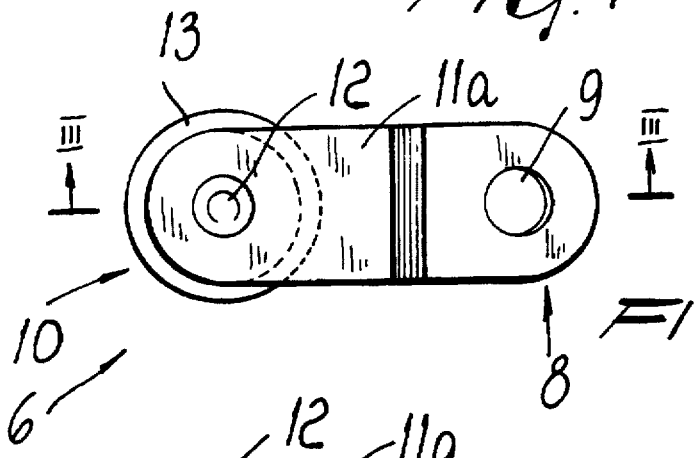
FIG. 2 is a top view of the device.
Figure 3:
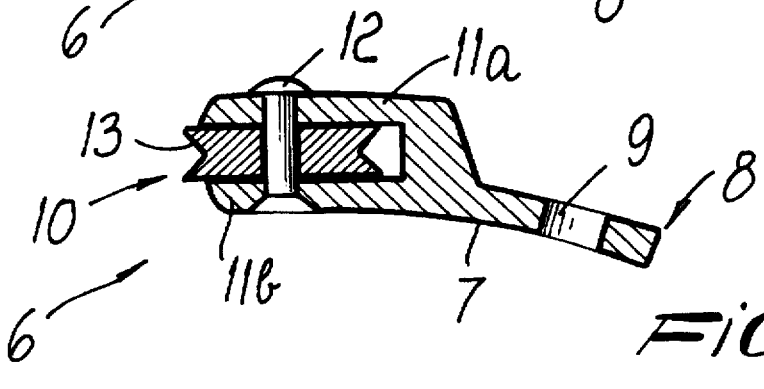
FIG. 3 is a sectional view, taken along the plane III—III of FIG. 2.

With reference to the above figures, the reference numeral 1 designates a sports shoe which comprises an upper or a shell, designated by the reference numeral 2, which have two flaps or a tongue, designated by the reference numeral 3, to be fastened by means of laces or a cable, designated by the reference numeral 4.

The reference numeral 5 designates the fastening device, which comprises multiple pulley members 6 which are constituted by a preferably curved plate 7 which has, at one first end 8, a first hole 9 for coupling it, for example by a rivet, to the upper or shell 2, preferably in pairs which are arranged approximately mutually opposite with respect to the pair of flaps or tongue 3.

Each pulley member 6 has a second end 10 which is directed towards the longitudinal median axis of the shoe and is essentially C-shaped. A pulley 13 is associated between the wings 11*a* and 11*b* of said C-shaped end so that it can rotate freely, for example by means of a pivot 12.

The use of the invention is therefore as follows: once the fastening devices have been associated, preferably in pairs, transversely with respect to the shell or to the upper, the laces and/or the cable are inserted between the wings 11*a* and 11*b* of the pulley member 6, so as to arrange them at the groove of the pulley 13.

In this way, the user can apply optimum traction to the cable or to the laces simply by pulling at the loose ends of said cable or laces by virtue of the fact that the pulley substantially reduces friction, allowing optimum distribution of forces when the laces or cable are pulled.

It has thus been observed that the invention has achieved the intended aim and objects, a fastening device having been provided which can be applied to sports shoes and allows to tension laces or cables and thus fasten said shoe in a very quick and simple manner even in the worst weather conditions in which such fastening might occur.

Release is equally easy, as once the ends of the laces or of the cable have been loosened, a simple pressure of the foot instep on the shell or on the upper allows to loosen the traction elements as they can slide at the pulleys.

The arrangement of the pulley members 6 at the shell or upper may of course be the most pertinent according to the specific requirements.

Figure 4:
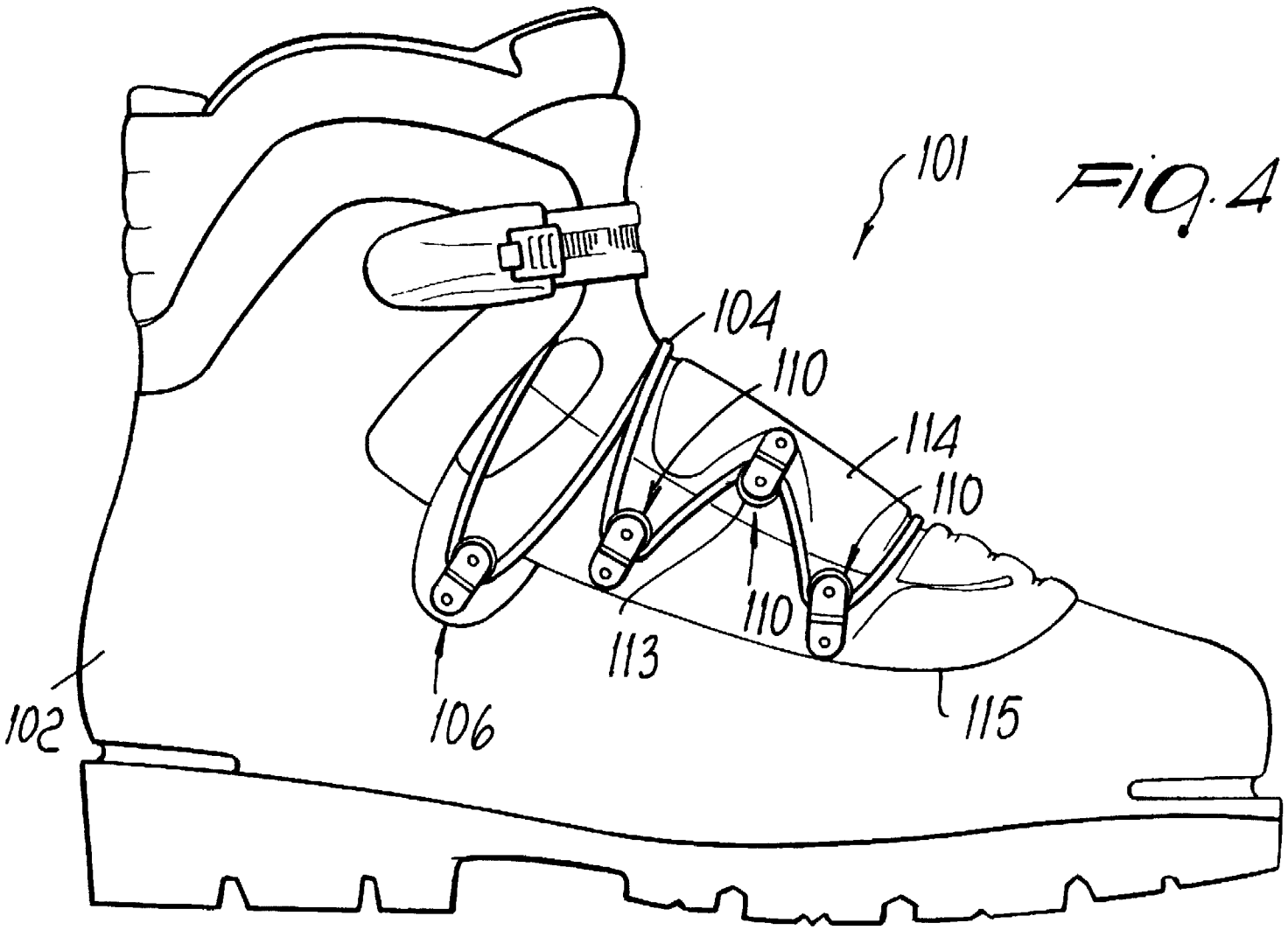
FIG. 4 is a view, similar to FIG. 1, of a different arrangement of the invention on the shoe.

Thus, for example, FIG. 4 illustrates a sports shoe 101 in which some pulley members 106 are associated with the upper or shell 102 and others are associated with a tongue 114 which is frontally associated with said upper or shell.

Furthermore, in one or more of said pulley members 106 the second end 110 with which the pulley 113 is associated is directed towards the median longitudinal axis of the tongue 114, whereas in other pulley members the second end is directed towards the lateral edges 115 of said tongue.

Accordingly, the shoe 101 has, in a conventional manner, a longitudinal extension extending from a toe portion to a heel portion of the shoe, and a median plane extending in the direction of the longitudinal extension between two lateral portions of the shoe.

The pulley members 106 as seen in FIG. 4 are connected to one of the lateral portions of the shoe 101, and in one or more of such pulley members 106 the second end 110 with the pulley 113 is arranged nearer to the median plane of the shoe than is the first end, connected to the shoe, of the pulley members 106, while in other of such pulley members 106 the first end connected to the shoe is arranged nearer to the median plane of the shoe than is the second end with the pulley 113.

This opposite arrangement of some pulley members 106 allows to provide a different path for the laces or cable 104 and thus ensures a further improvement in their tensioning, in addition to allowing better distribution of the fastening forces.

Figure 5:
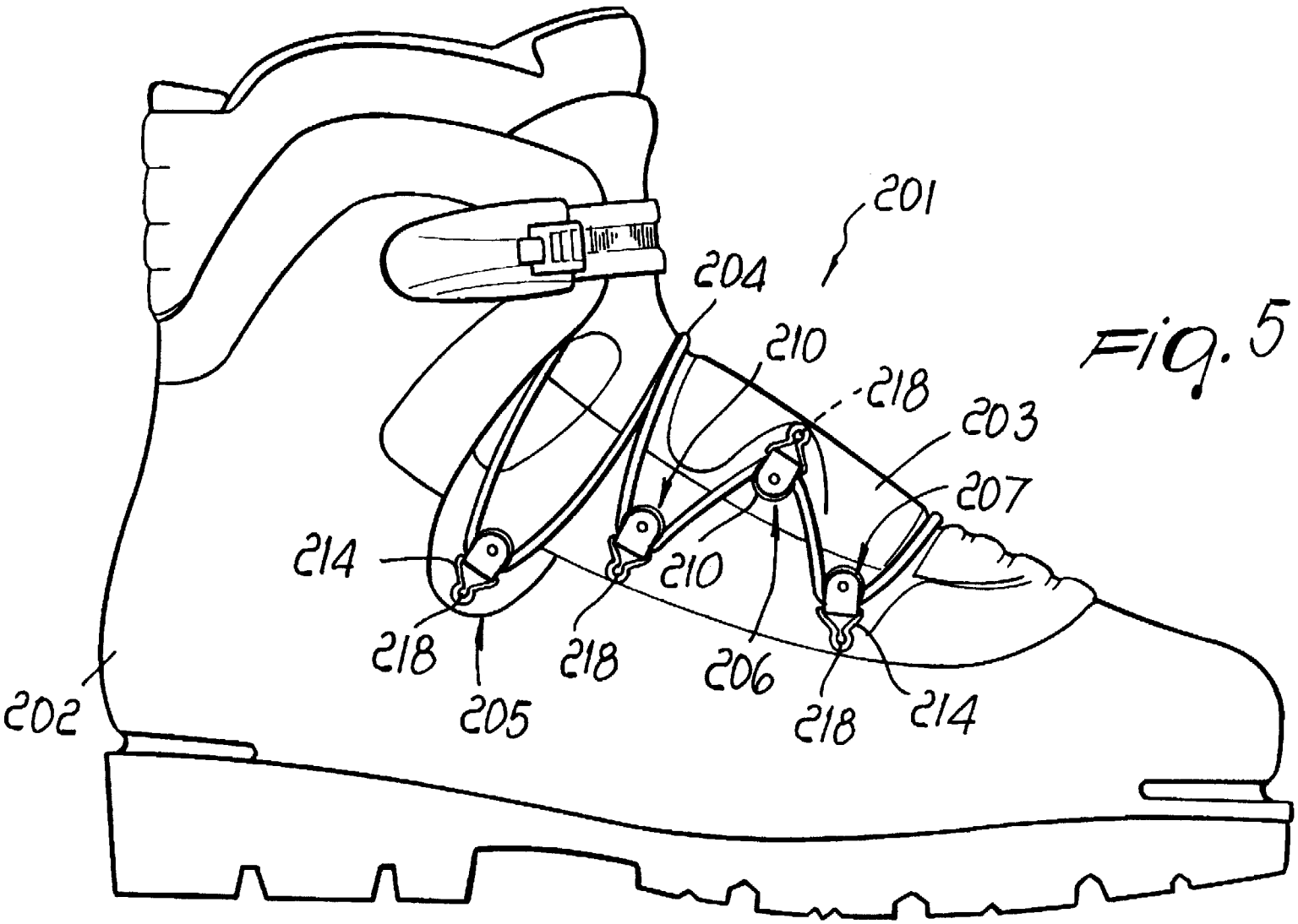
FIG. 5 is a side view of a sports shoe having a device according to a further aspect of the invention.
Figure 6:
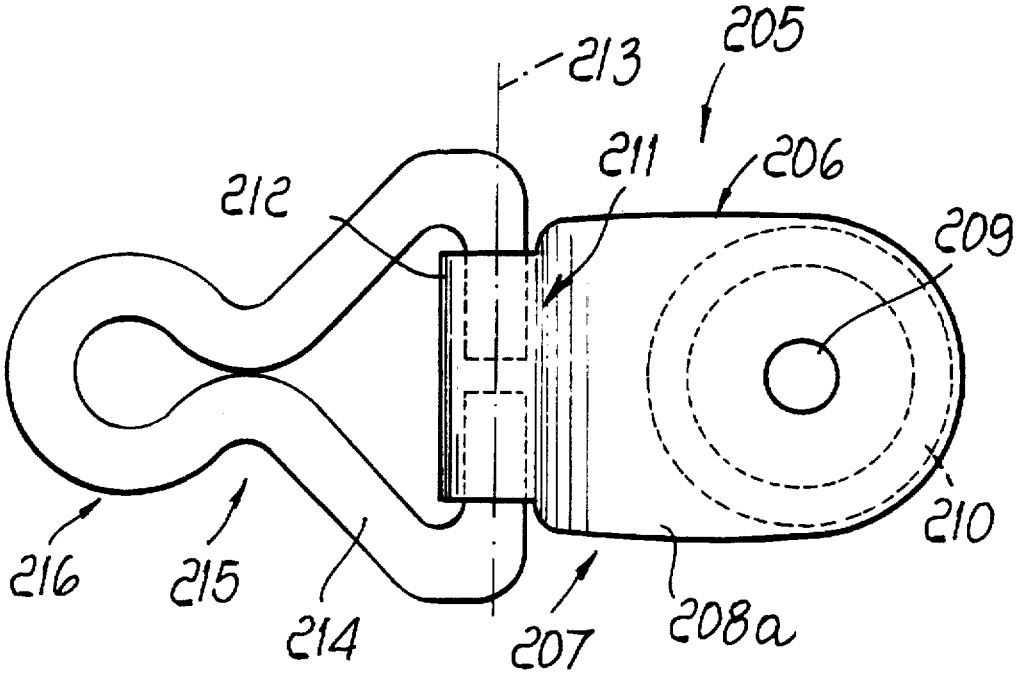
FIG. 6 is a top view of the device of FIG. 5.
Figure 7:
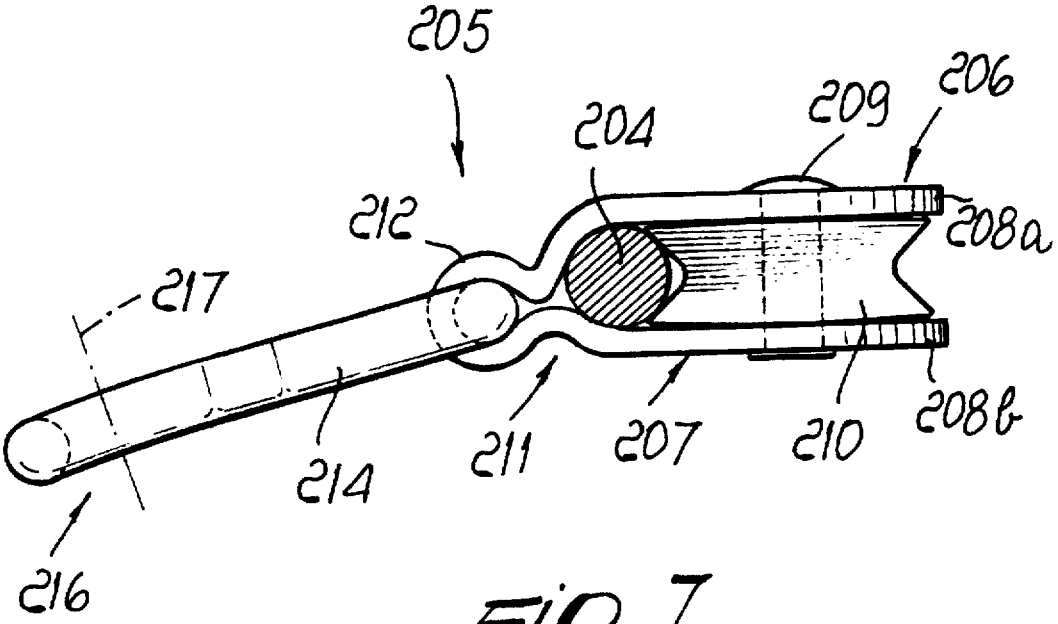
FIG. 7 is a side view of the device of FIG. 6.

With reference to FIGS. 5–7, the reference numeral 201 designates a sports shoe which comprises an upper or a shell, designated by the reference numeral 202, which have two flaps or a tongue, designated by the reference numeral 203, to be fastened by means of laces or a cable, designated by the reference numeral 204.

The reference numeral 205 designates the fastening device, which comprises a plurality of pulley members 206 which are constituted by an essentially C-shaped plate 207 between the wings **208*a* and 208*b* of which a pulley 210 is associated so that it can rotate freely for example by means of a first pivot 209 proximate to the free ends of the plate 209**.

A sleeve 212 is formed at the base 211 of each plate 207 by bending and is arranged along a first axis 213 which lies approximately at right angles to the axis of the first pivot 209.

The fastening device also comprises a means for coupling to said flaps or upper or shell. The means is constituted by a metal wire 214 which is essentially shaped like a triangle in which the base is rotatably freely associated with said sleeve 212 and the vertex 215 is shaped so as to form an eyelet 216.

Said eyelet has in turn a second axis 217 which lies approximately at right angles to the first axis 213 and is approximately parallel to the axis of the first pivot 209; a second pivot 218 for coupling to said flaps or upper or shell is associated at the eyelet.

The use of the invention is therefore as follows: once the fastening devices have been associated, preferably in pairs, transversely with respect to the shell or to the upper, the laces and/or the cable are inserted between the wings **208*a* and 208*b* of each pulley member 206, so as to arrange them at the groove of the pulley 210**.

In this way, the user can apply optimum traction to the cable or to the laces simply by pulling at the loose ends of said cable or laces by virtue of the fact that each device can adapt both to the shape of the shoe and spontaneously center itself with respect to the forces involved; this is possible by virtue of the oscillation of the plate, 207 with respect to the first axis 213 and of the eyelet 216 with respect to the second axis 217.

It is thus possible to reduce friction substantially, allowing the optimum distribution of forces while tightening the laces or the cable.

Release is easy too, as once the ends of the laces or cable have been loosened, a simple pressure of the foot instep on the shell or on the upper allows to loosen the traction elements as they can slide at the pulleys.

The possibility of arranging the pulley members in the desired point of the shell or of the upper, together with the possibility of each pulley member to orientate itself according to the force applied to the cable or to the laces, also allows to further increase the securing force also according to the shape of the foot, by virtue of the self-adaptation of the orientation of the individual elements along the two axes 213 and 217.

FIGS. 8 and 9 illustrate a fastening device 305 having a means for coupling to said flaps or upper or shell, constituted by a base 319 from the sides of which two wings **320*a* and 320*b* protrude; a second pivot 321 is freely associated between said wings and can in turn be arranged within the sleeve 312 of the plate 307**, which can thus oscillate freely.

The plate 319 also has a first end 322 which lies partially below the plate 307 and a second end 323 that protrudes beyond the pair of wings **320*a* and 320*b*; a through hole 324 is formed on said plate 319 and has a second axis 317 which lies approximately at right angles to the first axis 313 and is approximately parallel to the axis of the first pivot 309**.

The number of pulley members, as well as their specific arrangement, their size or their materials, may of course be the most pertinent according to the specific requirements.

What is claimed is:

1. A fastening device connected to a shoe, the fastening device comprising a fastening lace and at least one pulley member connected to the shoe, said pulley member comprising:

a first end;

a second end arranged distally from the first end;

an extension which extends between the first and second ends;

a pulley element for sliding engagement with the fastening lace, said pulley element being rotatably pivoted to said first end about a pulley pivot axis;

a first pivot connection which pivotally connects said second end of the pulley member to the shoe such that said second end may rotate about a first pivot axis; and a second pivot connection arranged at said extension between the first and second ends which pivotally connects said first end to said second end such that said first end may freely rotate about a second pivot axis;

wherein said first pivot axis and said second pivot axis are arranged mutually distally from one another and wherein said first pivot axis extends substantially perpendicularly with respect to said second pivot axis.

2. The fastening device of claim 1 wherein said first pivot axis and said pulley pivot axis are arranged mutually distally from one another and wherein said first pivot axis extends substantially parallel to said pulley pivot axis.

3. The fastening device of claim 1 comprising a plurality of pulley members each comprising:

said first end; said second end; said extension; said pulley element; said first pivot connection; and said second pivot connection;

said shoe having a longitudinal extension extending from a toe portion to a heel portion of the shoe, and a median plane extending in the direction of said longitudinal extension between two lateral portions of the shoe;

wherein at least one of said pulley members is connected to one of said lateral portions such that the first end of said at least one of said pulley members is arranged nearer said median plane than is the second end of said at least one of said pulley members;

and wherein at least another one of said pulley members is connected to said one of said lateral portions such that the second end of said at least another one of said pulley members is arranged nearer said median plane than is the first end of said at least another one of said pulley members.

* * * * *